United States Patent [19]

Lueth

[11] Patent Number: 4,575,449

[45] **Date of Patent: * Mar. 11, 1986**

[54] METALLURGICAL PROCESS

[75] Inventor: Roy C. Lueth, St. Clair, Mich.

[73] Assignee: Ultra-Temp Corporation, Mt. Clemens, Mich.

[ * ] Notice: The portion of the term of this patent subsequent to Feb. 14, 2001 has been disclaimed.

[21] Appl. No.: 535,278

[22] Filed: Sep. 23, 1983

Related U.S. Application Data

[63] Continuation-in-part of Ser. No. 375,681, May 6, 1982, Pat. No. 4,431,605.

[51] Int. Cl.[4] ..... B22F 3/00

[52] U.S. Cl. ..... 419/26; 419/28; 419/29; 419/47; 419/57; 264/56; 264/65; 264/332

[58] Field of Search ..... 419/47, 26, 28, 29, 419/57; 264/56, 65, 332

[56] References Cited

U.S. PATENT DOCUMENTS

| | | | |
|---|---|---|---|
| 2,263,520 | 11/1941 | Romp | 75/137 |
| 3,937,630 | 2/1976 | Kimura et al. | 419/47 |
| 4,431,605 | 2/1984 | Lueth | 419/47 X |

FOREIGN PATENT DOCUMENTS

| | | |
|---|---|---|
| 314212 | 3/1974 | Austria . |
| 793020 | 1/1936 | France . |
| 469528 | 10/1968 | Japan . |

OTHER PUBLICATIONS

Pages 6 and 64 of San Sonov G.V. Hot Pressing Technology in the Soviet Machine Building and Metallurgical Industries.

Goetzel Treatise on Powder Metallurgy, vol. 1949 (pp. 424–425).

*Primary Examiner*—Stephen J. Lechert, Jr.

*Attorney, Agent, or Firm*—Gifford, Groh, VanOphem, Sheridan, Sprinkle & Dolhorukov

[57] ABSTRACT

The present invention discloses a method for densifying previously sintered parts constructed of powdered metals, ceramics or the like to nearly 100% theoretical density. The method of the present invention comprises heating the parts containing binder and hard phase above their liquid phase temperature and then applying a pressure in a predetermined range to the parts for a predetermined period of time and simultaneously maintaining the parts at or above their liquid phase temperature. This pressure range is set so that the pressure is below the pressure necessary to overcome the capillary force acting on the binder to keep the binder from entering the voids but above the pressure necessary to physically move or collapse themicrostructure inwardly, thus filling the voids with a homogeneous mixture of binder and hard phase. The method of the present invention achieves complete closure of even large voids and the elimination of substantially all porosity within the part.

6 Claims, 16 Drawing Figures

METALLURGICAL PROCESS

CROSS REFERENCE TO RELATED APPLICATIONS

This application is a continuation-in-part of U.S. patent application Ser. No. 375,681, entitled METALLURGICAL PROCESS, filed on May 6, 1982, and now U.S. Pat. No. 4,431,605.

BACKGROUND OF THE INVENTION

I. Field of the Invention

The present invention relates to a method for densifying previously sintered parts of powdered metals, ceramics and the like.

II. Description of the Prior Art

In the liquid phase sintering of powdered metals, ceramics and the like, the powdered material comprising a powdered hard phase and powdered binder is first intermixed with a fugitive binder which holds the part in the desired shape after cold pressing. Usually this fugitive binder or "wax" consists of a paraffin, polyetheleneglycol or a metal containing hydrocarbon. The cold pressed part is conventionally known as a preform.

The preforms are then subjected to a presintering step in which the preforms are slowly heated thus vaporizing the fugitive binder and the vaporized binder is removed from the part by a wash gas, vacuum pumping or other means. Following the presintering step, the parts retain their shape despite the absence of the fugitive binder due to some solid-state sintering of the powdered binder.

The parts are then subjected to a sintering operation in which the parts are raised to their liquid phase temperature which not only densifies the parts but also further releases any residual contaminants contained within the parts. These contaminants are removed from the part during the sintering operation by vacuum pumping or by flowing a wash gas, such as hydrogen, across the parts. Following the sintering of the parts, the parts are sufficiently dense and hard for many applications.

These sintered parts comprise hard phase particles such as tungsten, held together by the binder, such as cobalt. Following the sintering operation, the part contains many voids surrounded by a mix of hard phase particles and binder and in which the hard phase particles are spaced from each other by a distance less than the width of the void size.

For applications requiring still further densification, greater strength of the sintered part or better internal integrity, these properties of the part can be improved by subjecting the part to hot isostatic pressing or "HIP" processing. During HIP processing, the parts are ressurized to about 5000 psi and then elevated to their liquid phase temperature, for a period of 60 to 90 minutes. At this temperature, the pressure increases to above 10,000 psi due to thermal expansion. The primary advantage of HIP processing is to eliminate virtually all porosity within the part as well as greatly minimizing larger randomly spaced holes, slits or fractures which may be present in the part provided that such holes, slits or fractures are not open to the surface.

During the HIP process, as the parts are heated above solidus, the binder, e.g. cobalt, becomes molten and the spaces between the hard phase particles form capillary passageways which are open to the voids in the part. In the absence of pressure applied to the part the capillary force created by these passageways would prevent any molten binder contained within the part from entering the voids of the part.

During the HIP process, however, extremely high pressures, e.g. 5000 psi, are applied to the parts at a temperature below liquidus and this pressure is sufficient to overcome this capillary force once the material is heated above liquidus. Consequently, after the parts are heated above liquidus the high pressure forces the molten binder into the voids against the capillary force and results in what is well known in the art as "binder laking". Typically, the capillary force is about 1600 psi.

An example of such "binder laking" is shown in prior art FIG. 15 (1500X magnification) in which a 15% cobalt carbide part was subjected to the HIP process. FIG. 16 (500X magnification) also shows a Carboloy General Electric MPD grade 268 after HIP processing. Large cobalt lakes are evident throughout the parts in both FIGS. 15 and 16. Although laking is preferable to porosity, it is less preferable than a more homogenous microstructure for the part.

A still further disadvantage of HIP Processing is that, due to the high temperatures and high pressures used during the HIP processing, the previously known HIP equipment is extremely massive in construction and expensive to produce and acquire. Furthermore, the long cycle time for the HIP processing limits the production volume of HIP equipment and greatly increases the per part cost of the parts which are HIP treated.

SUMMARY OF THE PRESENT INVENTION

The present invention provides a method for densifying previously sintered parts which overcomes all of the above mentioned disadvantages of HIP processing.

In brief, the method of the present invention comprises placing previously sintered parts within a pressurizable chamber. The parts may be either vacuum or hydrogen sintered and, similarly, may be cooled following the sintering step.

The parts are then heated to their liquid phase temperature. The liquid phase temperature will vary, of course, depending upon the part material. Typically, however, the liquid phase temperature is in the range of 1,300° C. to 1,600° C.

With the parts at their liquid phase temperature, the pressure vessel is pressurized with an inert gas, such as argon, to a range which is below the pressure necessary to overcome the capillary force acting on the binder to prevent it from entering the voids but sufficient to physically move or collapse the structure inwardly into any voids present in the part. Typically, this pressure is in the range of 50–2,000 psi. The parts are maintained within the pressure vessel at their liquid phase temperature and subject to this pressure for a relatively short period of time, typically 30–60 minutes, and then removed from the furnace chamber. For previously sintered parts the presure vessel can be heated first and then pressurized, pressurized first and then heated or simultaneously pressurized and heated. In the event that sintering is performed in the same vessel, pressure is applied immediately after sintering is completed.

Consequently, in the method of the present invention, the capillary force imposed on the molten binder prevents the binder from entering into the voids. The pressure applied externally to the part, however, is sufficient to physically move or collapse the structure inwardly, thus filling the voids with a homogenous mixture of hard phase and binder and virtually eliminating all "binder laking".

In practice, the method of the present invention substantially eliminates all porosity within the parts as well as closing larger randomly spaced holes, slits or fractures in the part in a manner comparable to and, in many cases, superior to HIP processing.

BRIEF DESCRIPTION OF THE DRAWING

A better understanding of the present invention will be had with reference to the following detailed description when read in conjunction with the accompanying drawing, in which.

DETAILED DESCRIPTION OF A PREFERRED EMBODIMENT OF THE PRESENT INVENTION

The method of the present invention is designed to further densify previously sintered parts constructed from powdered metal, ceramics or the like. As used in this application, previously sintered parts mean parts that have been raised to liquid phase temperature regardless of whether the parts are cooled following sinter. It has been found through test results that the method used to sinter parts, i.e., whether the parts were subjected to vacuum pumping of wash gas during the sintering operation, has no observable effect on the parts following the treatment of the parts by the present method. Similarly, whether or not the sintered parts have been cooled following the sintering operation has no observable effect on the parts following treatment of the parts by the present method.

In brief, in the method of the present invention the sintered parts are placed within a pressurizable chamber. The parts are then heated to the liquid phase temperature, i.e., the melting point, of the parts. The chamber is also pressurized with an inert gas, such as argon, to a pressure which is less than and thus insufficient to overcome the capillary force acting on the molten binder so that the binder is not forced into voids in the part. This pressure, however, is greater than and thus sufficient to physically move or collapse the structure inwardly thus forcing a homogenous mixture of hard phase and binder into the voids. Although the precise pressure varies between different hard phase and binders, the preferred pressure range is between 50 and 2000 psi. The parts are maintained at their liquid phase temperature and at the selected pressurization for a relatively short period of time, typically 30–60 minutes.

Following the predetermined period of time, the chamber is depressurized and the parts are removed. Test results have established that the method of the present invention effectively eliminates substantially all porosity within the sintered part as well as closing large holes or flaws, by filling such holes with a homogenous hard phase and binder mixture. Since binder laking is eliminated, parts produced by the present method are superior to those produced by HIP processing.

The following examples indicates how the method of the present invention may be used to close a large flaw as well as decrease the porosity in a sintered part:

EXAMPLE 1

Conventional vacuum sintering to show a large flaw.

1. Material—(90% WC—10% Co) Medium size grain alloy; Ra 88.6.
2. Place 15 grams of powder in one inch diameter mold.
3. Place paraffin shaving—½" long, approximately 0.02" diameter—on powder to produce medium size flaw.
4. Add 15 grams of powder.
5. Place paraffin shaving—½" long, approximately 0.05" diameter—on powder to produce large flaw.
6. Add another 15 grams of powder.
7. Press powder mechanically at 30,000 psi.
8. Vacuum dewax bar at 420° C.
9. Sintering Cycle—Temperature 1415° C.

Pressure—100 microns Hg.

Time—90 minutes, then cool.

Figure 1:
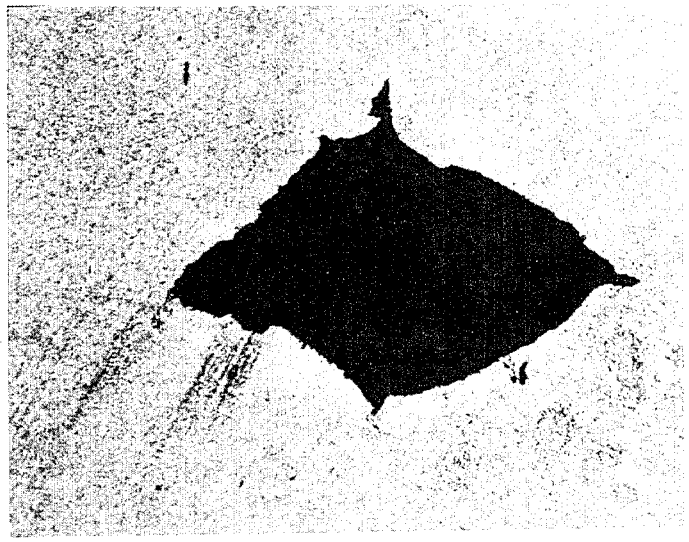
FIGS. 1–14 are all microphotographs of the cross section of parts illustrating the present invention.

The resulting cemented tungsten carbide bar from Example 1 has two large flaws, one of which is shown in FIG. 1 at 75X magnification.

EXAMPLE 2

The parts produced by the steps described in Example 1 were then subjected to the following steps:

1. Maintained at liquid phase temperature following sinter—1415° C.
2. Pressurized with argon gas to pressure of 250 psi.
3. Time—30 minutes.

Figure 2:
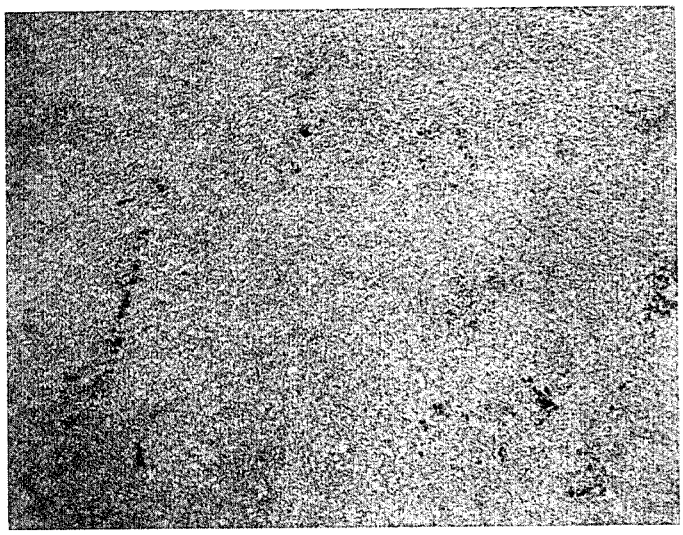
Figure 3:
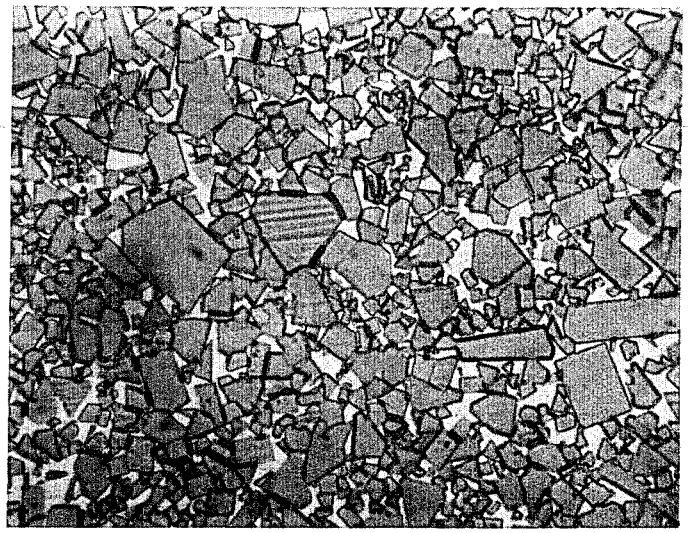

FIGS. 2 and 3 illustrate the complete closure of the large flaw at 75X and 1500X magnification, respectively, and with an absence of cobalt laking.

EXAMPLE 3

The parts produced by the steps described in Example 1 were then subjected to the following steps:

1. Parts maintained at 1415° C. following sinter.
2. Pressurized with argon to 90 psi.
3. Time—30 minutes.

Figure 4:
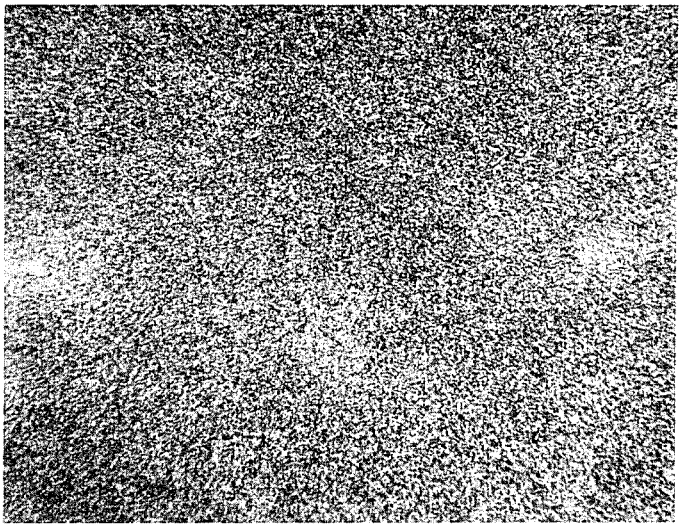
Figure 5:
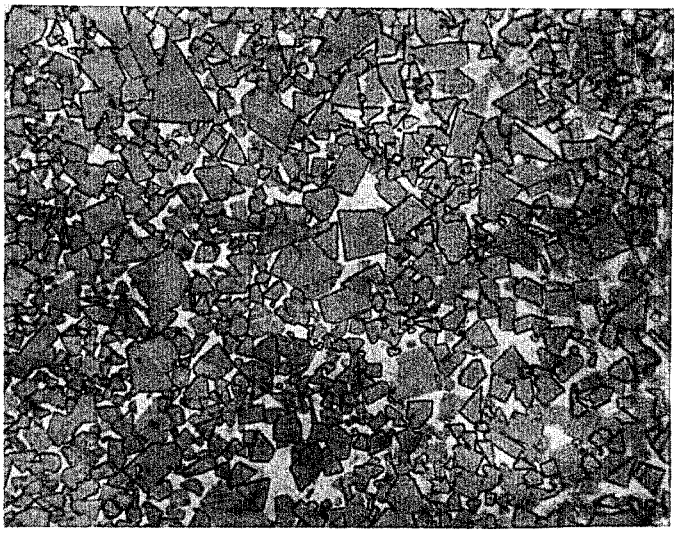

FIGS. 4 and 5 illustrate complete closure of the large flaw at 75X and 1500X magnification, respectively, with an absence of cobalt laking.

EXAMPLE 4

1. Repeat steps 1–7 of Example 1.
2. Dewax in hydrogen stoking furnace.
3. Sinter in hydrogen stoking furnace.

Temperature—1415° C.

Time—90 minutes.

Figure 6:
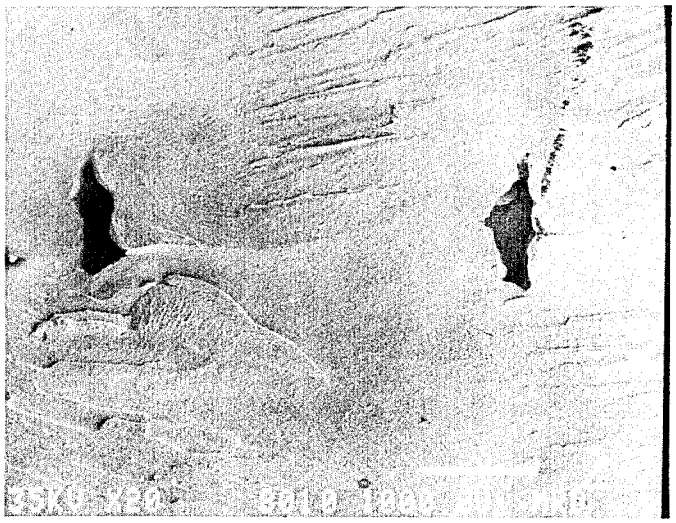

The resulting cemented tungsten carbide bar from Example 4 has two large flaws as shown in FIG. 6 at 20X magnification.

EXAMPLE 5

The parts from the lot of Example 4 were then subjected to the following steps:

1. Pressurized with argon to 160 psi at room temperature.
2. Heated to liquid phase temperature—1415° C. whereupon the pressure rises to 250 psi.
3. Maintained at temperature and pressure for 30 minutes.

Figure 7:
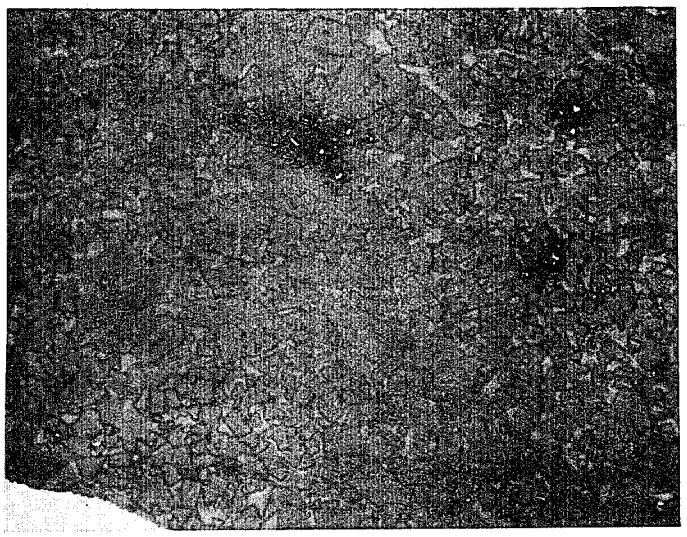
Figure 8:
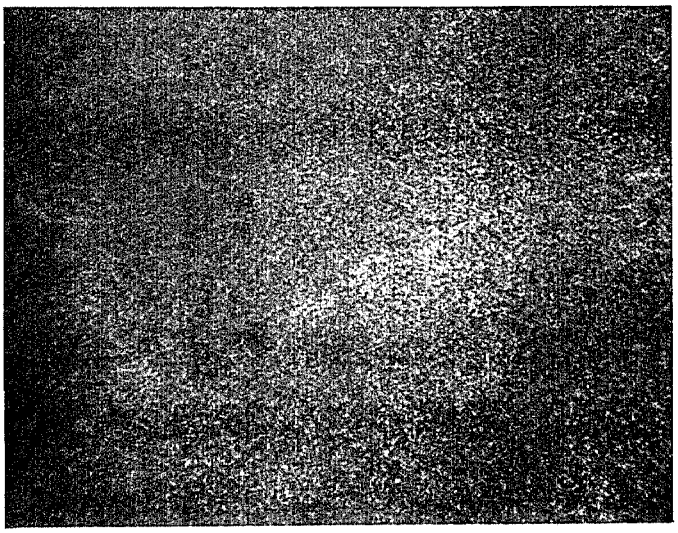

FIGS. 7 and 8 show complete closure of the large flaw at 1500X and 75X magnification, respectively, with no cobalt laking.

EXAMPLE 6

Figure 9:
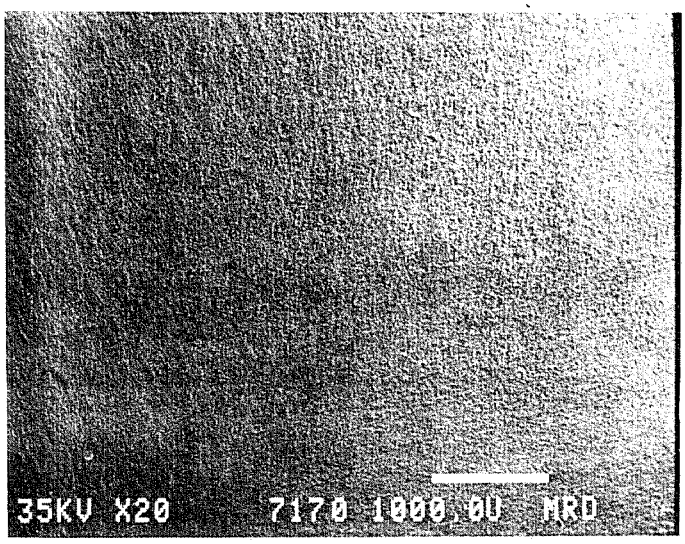
Figure 10:
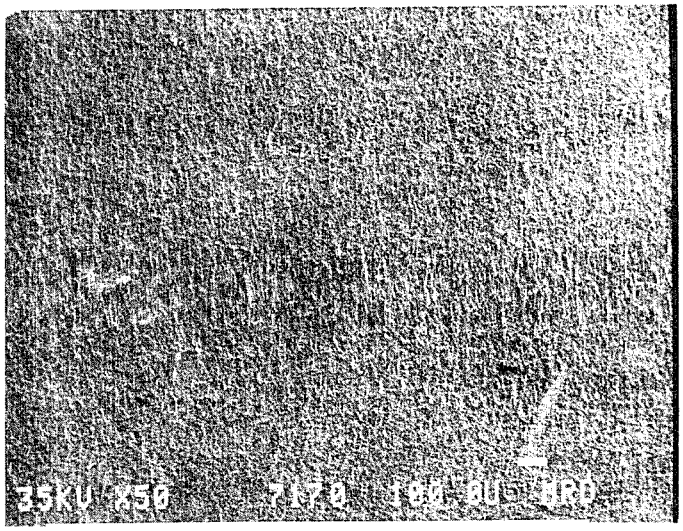

The parts from the lot of Example 1 were treated the same as Example 5. FIGS. 9 and 10 illustrate complete closure of the large flaw at 20X and 50X magnification, respectively.

EXAMPLE 7

The parts from the lot of Example 1 were treated in the same fashion as Example 2 except that the parts were cooled following sinter.

Figure 11:
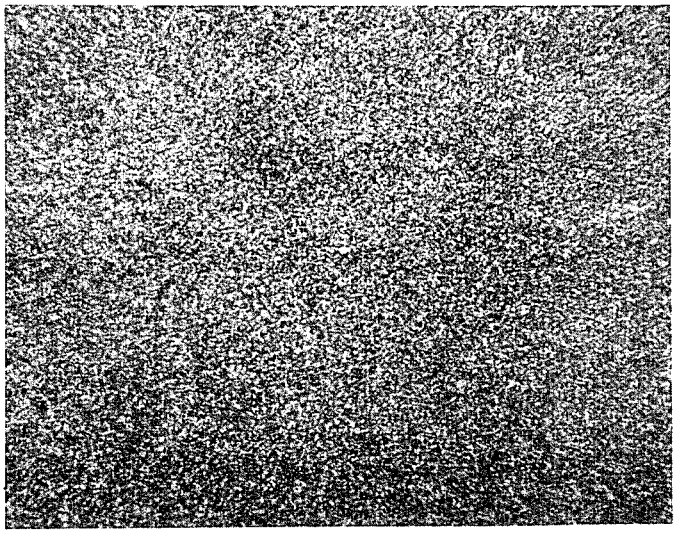
Figure 12:
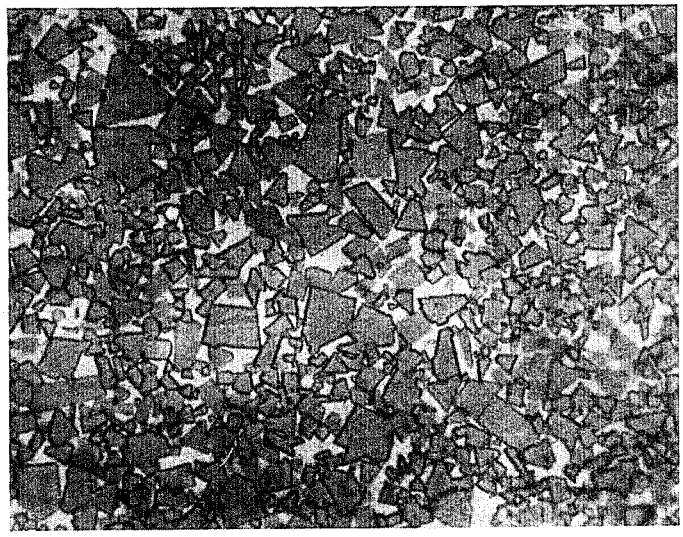

FIGS. 11 and 12 show complete closure of the large flaw at 75X and 1500X magnification, respectively.

EXAMPLE 8

The parts were processed in a manner identical to Example 1 except that 16% cobalt powder was used.

The following steps were performed:

1. Heat parts to liquid phase temperature—1415° C.
2. Pressure to 50 psi and hold for 30 minutes.

Figure 13:
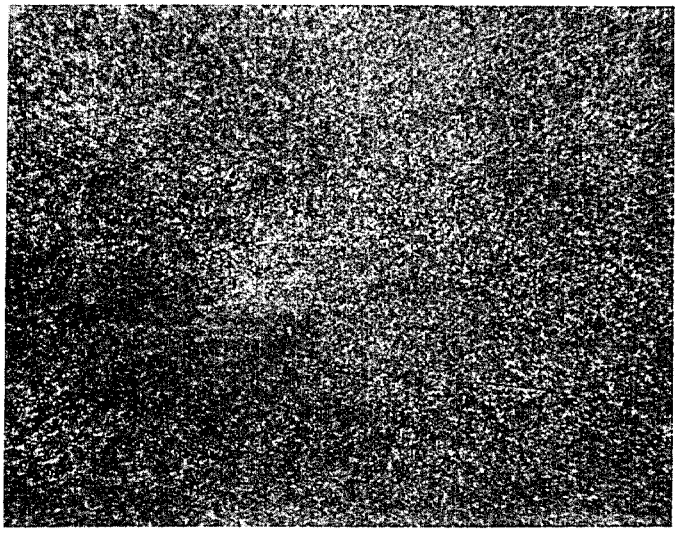
Figure 14:
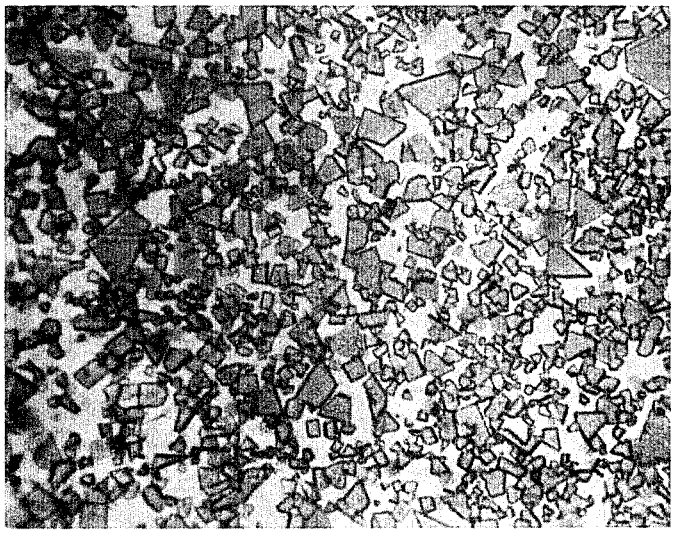
Figure 15:
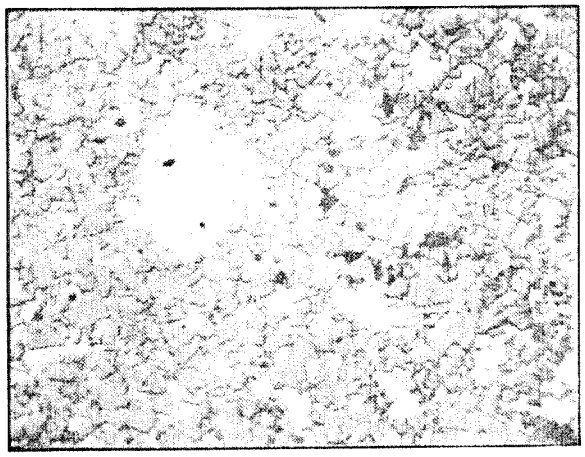
Fig - 15 Prior Art
FIGS. 15 and 16 are prior art microphotographs.
Figure 16:
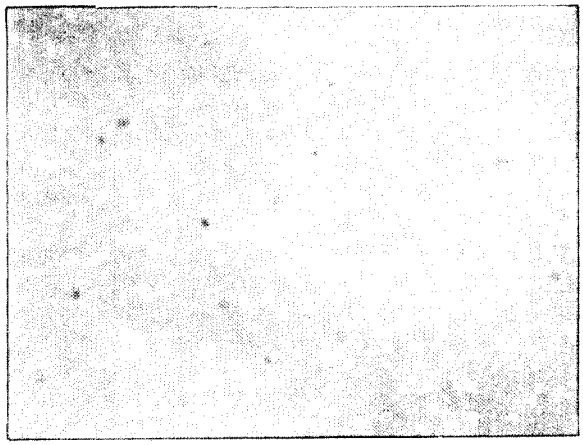
Fig - 16 Prior Art

FIGS. 13 and 14 illustrate complete closure of the flaws at 75X and 1500X magnification, respectively. Test results have also shown that with 10% cobalt material, complete closure of the flaws is not possible at 50 psi. A pressure of 50 psi is below the pressure necessary to overcome the capillary force imposed on the molten cobalt, but is also insufficient to physically collapse the parts to obtain void closure.

From the foregoing, it can be seen that the method of the present invention provides a substantial increase in the densification of a previously sintered part. As previously set forth, the actual method employed in sintering the part has no observable effect on the densification or hole closure obtained by the practice of the present method. Likewise, it does not matter whether or not the sintered parts are cooled prior to treating the parts according to the method of the present invention nor does it matter if the parts are exposed to air following sinter.

The densification and microstructural development of sintered parts obtainable by the method of the present invention are comparable or even superior to the corresponding densification and microstructure development obtainable from the previously known HIP process. The present invention, however, is advantageous over the HIP process since the present method employs comparatively much lower pressures than those used in the HIP process. As such, the machinery and equipment necessary to practice the method of the present invention is much less massive and, therefore, much less expensive in construction than the corresponding machinery equipment necessary for the HIP process.

A still further advantage of the method of the present invention is that the cycle time of the present method is much shorter than the corresponding cycle time of the HIP process. As such, a much greater volume of parts can be processed from a similarly sized furnace while practicing the present method than can be processed over the same time period with a similarly sized furnace using the HIP process.

A still further advantage of the present invention is that the voids are filled with material having a homogenous microstructure, thus, minimizing and even eliminating "binder laking".

Although the method of the present invention pressurizes the parts to a pressurization of between 50–2000 psi, preferably this pressure range is 50–1000 psi and, still preferably, 50–300 psi. Likewise, although many types of metallurgical furnaces can be used to practice the method of the present invention, preferably, the metallurgical furnace described in my copending patent application entitled "Metallurgical Furnace" and filed on Mar. 22, 1982, and assigned Ser. No. 360,337 is used to practice the method of the present invention.

Having described my invention, however, many modifications thereto will become apparent to those skilled in the art to which it pertains without deviation from the spirit of the invention as defined by the scope of the appended claims.

I claim:

1. A method for densifying previously sintered parts containing internal voids and constructed from powdered metals, ceramics and binder, comprising the steps of:

placing said parts in a pressurizable chamber, heating said parts above the liquid phase temperature of the parts, applying a pressure in an amount below the capillary pressure imposed on molten binder in a direction away from the part voids and above the pressure necessary to physically collapse the part structure inwardly to said parts for a predetermined period of time while maintaining said parts above said liquid phase temperature, said applying step comprising the step of introducing a sufficient amount of a gas to said chamber to create said pressure.

2. The method as defined in claim 1 wherein said pressure applying step comprises applying pressure to said parts in the range of 50–2000 psi.

3. The method as defined in claim 1 wherein said pressure applying step comprises applying pressure to said parts in the range of 50–1000 psi.

4. The method as defined in claim 1 wherein said pressure applying step comprises applying a pressure to said parts in the range of 50–300 psi.

5. The method as defined in claim 1 wherein said gas comprises argon.

6. The method as defined in claim 1 wherein said predetermined period of time is in the range of 30–60 minutes.

* * * * *

UNITED STATES PATENT AND TRADEMARK OFFICE

CERTIFICATE OF CORRECTION

PATENT NO. : 4,575,449

DATED : March 11, 1986

INVENTOR(S) : Roy C. Lueth

It is certified that error appears in the above-identified patent and that said Letters Patent are hereby corrected as shown below:

In the abstract, line 14, delete "themicrostructure" and insert --the microstructure--.

Signed and Sealed this

Twenty-eighth Day of October, 1986

[SEAL]

*Attest:*

DONALD J. QUIGG

*Attesting Officer*

*Commissioner of Patents and Trademarks*